US007398714B1

(12) United States Patent
Mah et al.

(10) Patent No.: US 7,398,714 B1
(45) Date of Patent: Jul. 15, 2008

(54) JAR OPENER

(75) Inventors: Pat Y. Mah, Kowloon (HK); Mark Andrew Sanders, Windsor (GB)

(73) Assignee: Daka Research Inc. (Br. Virg. Isl Corp.) OffshoreIncorporations, Tortolla (VG)

( * ) Notice: Subject to any disclaimer, the term of this patent is extended or adjusted under 35 U.S.C. 154(b) by 0 days.

(21) Appl. No.: 11/752,256

(22) Filed: May 22, 2007

(51) Int. Cl.
*B25B 7/00* (2006.01)

(52) U.S. Cl. ..... 81/300; 81/3.07; 81/3.2

(58) Field of Classification Search ..... 81/3.07, 81/3.2, 300
See application file for complete search history.

(56) References Cited

U.S. PATENT DOCUMENTS

| | | | | |
|---|---|---|---|---|
| 4,150,591 | A | 4/1979 | Ackeret | |
| 5,003,844 | A | 4/1991 | Barrow | |
| 5,203,236 | A | 4/1993 | Anderson | |
| 5,329,831 | A | 7/1994 | Pierce, Jr. et al. | |
| 5,345,844 | A * | 9/1994 | Marsaw | 81/3.2 |
| 5,617,765 | A | 4/1997 | Bennett | |
| 5,647,251 | A | 7/1997 | Hardman | |
| 6,125,718 | A | 10/2000 | Hill | |
| 6,293,170 | B1 | 9/2001 | Hajianpour | |
| 6,477,919 | B1 | 11/2002 | Thomas et al. | |
| 6,789,450 | B1 | 9/2004 | Helfet | |
| 6,862,954 | B2 * | 3/2005 | Dubois et al. | 81/3.2 |
| 6,868,960 | B2 | 3/2005 | Chung | |
| 6,959,952 | B2 | 11/2005 | Williams | |
| 7,024,965 | B2 | 4/2006 | Tremblay | |
| 7,040,194 | B2 * | 5/2006 | Wu et al. | 81/3.2 |
| 2003/0079567 | A1 | 5/2003 | Dubois | |
| 2003/0226425 | A1 | 12/2003 | Gotlib | |
| 2005/0229750 | A1 | 10/2005 | Duke | |
| 2006/0032336 | A1 | 2/2006 | Wu et al. | |

* cited by examiner

*Primary Examiner*—Joseph J. Hail, III
*Assistant Examiner*—Shantese L McDonald
(74) *Attorney, Agent, or Firm*—Curtis L. Harrington; Kathy E. Harrington; Harrington & Harrington

(57) ABSTRACT

A hand held, one touch jar opener can be placed on a jar and activated with a momentary touch of a button. An epicyclic gear train is set to sequentially provide a grip on a jar, and on a lid, followed by development of torque needed to move the lid in a counterclockwise direction with respect to the jar. The principles embodied in the opener shown can be realized in an opener which can be manually powered, or preferably motorized and possibly highly automated. A differential geartrain provides reduction of speed and increase in torque and then provides two balanced and opposing forces through the epicyclic gear assembly having sun and planet gears. This configuration enables a wide variety of screw-on lids and jars to be automatically closed to match the correct diameters, apply a gripping force and then apply torque in an opposing direction.

1 Claim, 6 Drawing Sheets

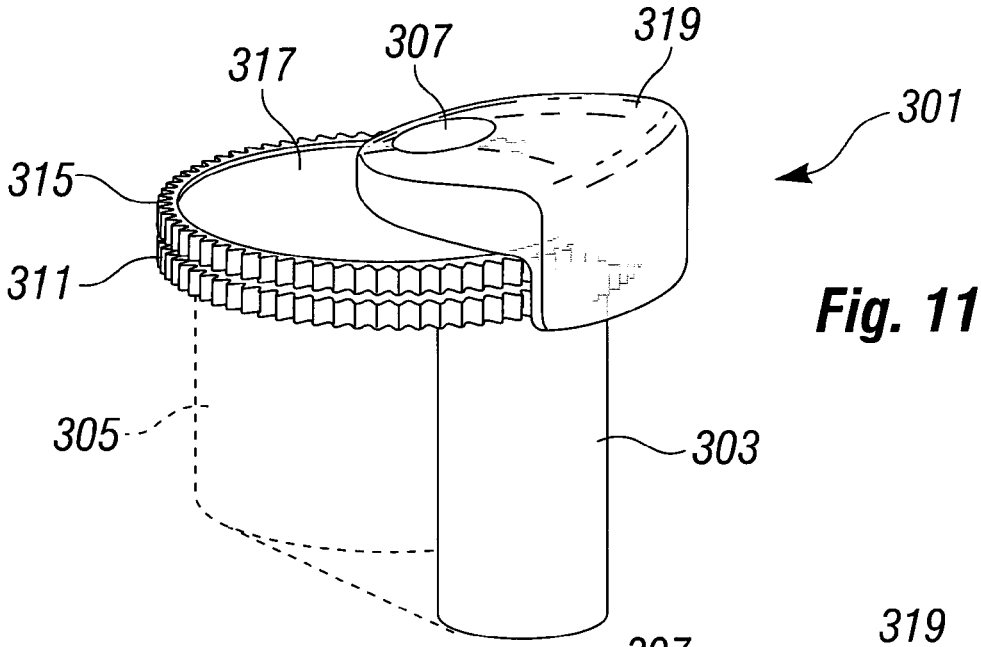
Fig. 11
Fig. 12
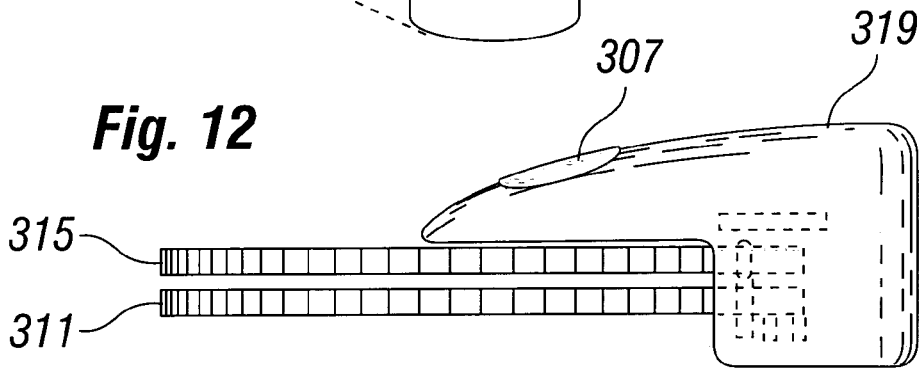
Fig. 13
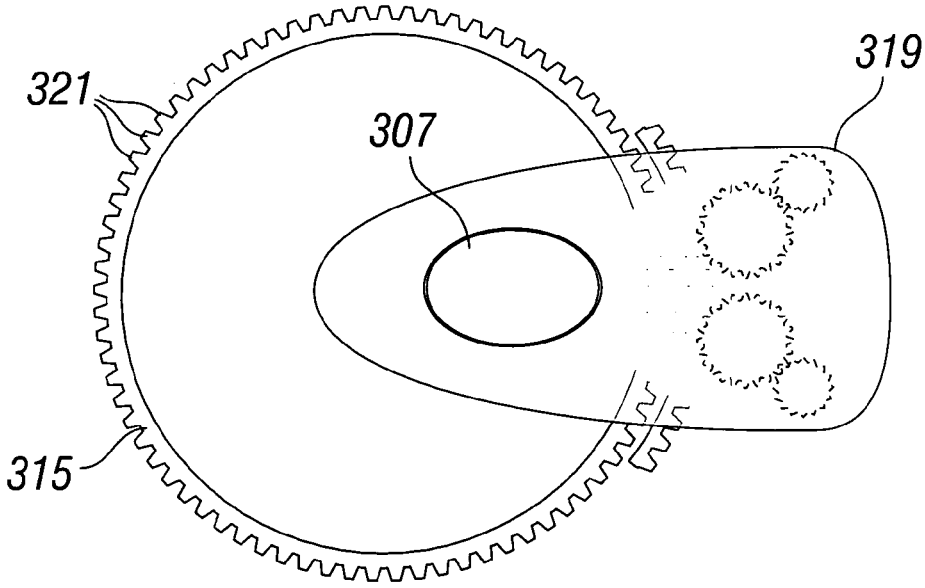

JAR OPENER

FIELD OF THE INVENTION

The present invention relates to improved technology in the field of reliable automatic jar openers which can be employed for convenience to an aid for individuals who may have trouble focussing the strength necessary to open a jar, and more particularly to improvements in Jar and Bottle screw top opening devices which enable a light, portable device operable with one touch, essentially hands free operation over the whole of lid loosening process which, from the user's perspective, involves nothing more than simply placing the device atop a jar to be opened and then pressing a button.

BACKGROUND OF THE INVENTION

Screw on Lids have been used on food and drink containers for over 100 years, with screw threads being an effective way of giving a high sealing force between lid and container, usually sealed by an elastomer seal. However, a combination of factors cause contemporary containers to be more difficult to first open than ever. Sometimes the contents are sealed with an internal vacuum for more security, which increases the force necessary to unseal the container. Other containers have a security mechanism or other additional structure. To overcome these sealing, friction and vacuum forces, Jar and bottle lids often require users with significant strength and manual dexterity to break the grip of the seal and loosen the lid. Once the lid is initially loosened, the loose lid can easily be removed by hand. Jar and bottle openers which aid unscrewing tight lids by giving user extra grip and mechanical leverage on the lid date back to 1900 and prior. Of the various methods of gripping jars and Lids, an "Edlund" has been utilized in which one structure which is turned in one direction can be used to grip and rotate simultaneously. A central turning handle includes a pinion which operates a rack to compress around a lid. The same direction of turning of the handle which causes the members to compress around the lid also enable turning of the lid once the maximum compression for a non turning lid is achieved.

The use of this mechanism has also been accomplished using a force gradient across the height of a container in a device which holds the bottom of the container and the top of the container, possibly using two separate "Edlund" devices, or one "Edlund" device and a static holder. One of the problems with this arrangement is that such a device is significantly large and occupies significant shelf space, and it takes time to load and secure the container to be opened, and compressive forces at the bottom of the container can cause container damage and breakage in the case of a glass container. Containers are not necessarily weakest adjacent their bottom support surface. Further, the device has to be unloaded after the opening process has completed. The lack of ease of use from loading and unloading, as well as counter space occupation makes these devices ineffective.

What is needed is a product which will not occupy significant shelf space, which is small, portable and will not subject containers to opening forces across the height of the container and which are simple to use. The needed device should not be wed to one size or configuration of container to be opened. The needed device should be cyclical and provide an automatic reset action after opening.

SUMMARY OF THE INVENTION

The container opening device, hereafter "jar opener" device of the present invention is a self contained device which can be held in one open hand and which can be gently placed atop a jar to be opened and operated with a single touch of a button. A pair of grippers, including a larger outer gripper and a smaller inner gripper act sequentially to grasp a container near the lid, and then grasp the lid and urge it in a direction to be opened.

The jar opener employs a mechanism which lends itself to being employed in either a manual or automatically powered device for containers which can range from a jar to a bottle. The range of sizes over which the jar opener can be employed may depend upon its size and range of grasping. The jar opener mimics the action of a pair of human hands by adjusting the grip on both the Jar and its lid to avoid slipping and applying an opposing torque without slipping. There are several methods for gripping a jar and lid, and applying the torque necessary to open the lid from the jar. It is understood that the invention is centered upon applying the force necessary to overcome an initial sealed condition or overly tightened condition, and generally the operation to turn multiple revolutions of the lid to provide ultimate physical separation of the lid from the container is not necessarily contemplated.

The preferred method of the invention and its methods disclosed works by using a differential gear train to cascade the application rotation input energy into a jar gripping body and a lid gripping body and secondly into the application of an opposing torque between the two gripping devices. The forces can be applied in any sequence to the jar gripping body and lid gripping body. A differential gear train uses a little used application of an epicyclic or planetary gear train. This gear arrangement includes the principle that when input rotation is applied to the sun gear, the planet carrier and annulus share and balance the output torque (as in a differential gear train). For the mechanism disclosed, it means that 2 gripping mechanisms, one for the container body, and one for the screw-on lid, can be first automatically closed to match the correct diameters and apply a gripping force and then continue in a manner which will apply torque in opposing directions.

As a result, the preferred embodiment of the invention operates by placing it on the flat topped lid of a screw top container, and pressing the start button. This one-touch feature means that other activities can be carried out while the jar opener is operating. The start button can activate switches, such as a latching switch which can reset the drive direction, and the other which can start a geared electric motor (probably battery operated). The sun gear of the epicyclic gear train can then be actuated as will be shown in the detailed description to begin the opening operation. (Finish)

BRIEF DESCRIPTION OF THE DRAWINGS

The invention, its configuration, construction, and operation will be best further described in the following detailed description, taken in conjunction with the accompanying drawings in which:

FIG. 11 illustrates jar opener using a belt topology and which is seen as having an off center design and which can be used equally as well for a slender cylindrical bottle as well as a large cylindrical jar;

FIG. 12 is a side plan view of the jar opener seen in FIG. 11;

FIG. 13 is a top view of the jar opener seen in FIGS. 11-12; and

DETAILED DESCRIPTION OF THE PREFERRED EMBODIMENT

Figure 1:
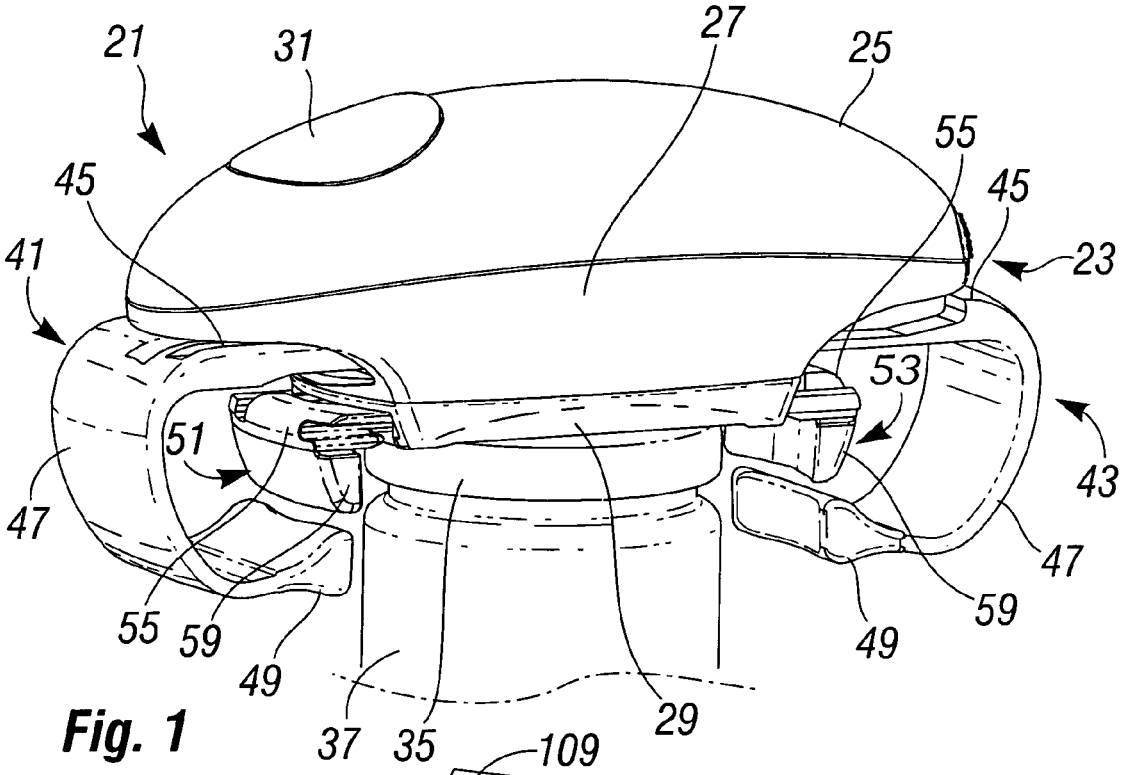
FIG. 1 is a perspective view from the right side of the hand held jar opener of the present invention.

The description and operation of the invention will be best initiated with reference to FIG. 1, which is a perspective view of a jar opener 21. Jar opener 21 has a main housing 23 which may include an upper housing 25 and a lower housing 27. Below the lower housing 27 is a rotation housing 29. A button 31 is seen through an aperture of the upper housing 25 and for locational reference is located nearer what will be referred to as the front of the jar opener 21. In use, the jar opener 21 will be grasped about its main housing 23 in a position to steady the jar opener 21 and to press the one touch button 31 with the user's index finger to operate the jar opener 21.

The jar opener 21 is shown with the underside of the rotation housing 29 supported atop a lid 35 which is threadably engaged to close a jar 37. A pair of main gripping members, herein after for the embodiment of FIGS. 1-10 which will be referred to as jaws, including a first main jaw 41 at the front of the jar opener 21 and a second main jaw 43 at the rear of the jar opener 21. The first and second main jaws 41 and 43 each have a rack portion 45 a curved portion 47, and a grip member 49. The grip member 49 may be flexible, coated or may pivot. Grip member 49 may be made of a soft material to create a high coefficient of friction with respect to the surface of jar 37.

Below the lower housing 27, and from the rotation housing 29 a pair of lid jaws, including a first lid jaw rack 51 at the front of the jar opener 21 and a second lid jaw rack 53 at the rear of the jar opener 21. The first and second lid jaw racks 51 and 53 each have a rack portion 55 and a downwardly extending lid grip member 59. The lid grip member 59 may be flexible, coated or may be angled slightly inwardly to insure that jar lid 35 is positively engaged. Grip members 59 are also made of high coefficient of friction material. Generally, the position of the jar opener 21 with respect to the jar 37 and lid 35 is a position as it would be placed, just before activation by pressing the button 31.

Figure 2:
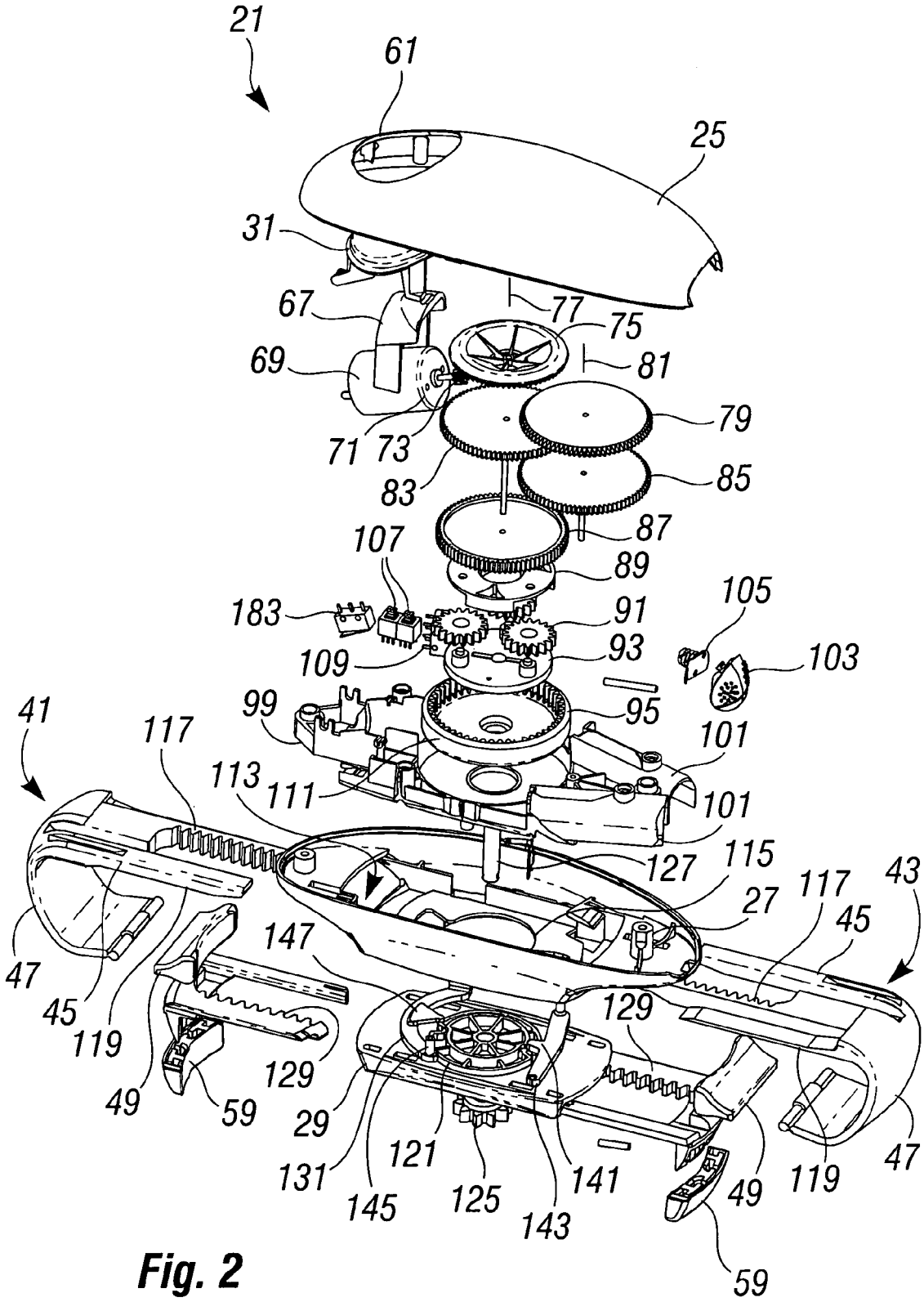
FIG. 2 is an exploded view of the hand held jar opener seen in FIG. 1.

Referring to FIG. 2, an exploded view of the jar opener 21 seen in FIG. 1 is illustrated. A general recitation of the component parts will be followed by a more in-depth discussion of the force principals involved. From the top of FIG. 2, a button aperture 61 is seen through which button 31 extends. Button 31 may have structures which enable manual reach of switches to be shown.

A motor clamp 67 is seen in a position somewhat saddling a motor 69. The motor 69 may have a shaft 71 and pinion gear 73. A series of reduction gears are mounted on two axes in an offset fashion to capture the high speed force from the pinion gear 73 into a lower speed higher torque force for use in the final gear sequence of the jar opener 21. In its operating position, the motor 69 is angled to the approximate degree seen in FIG. 2. The pinion gear engages a series of downwardly directed radially arranged teeth in an angle gear 75. Note that the top of the angle gear 75 has an upper ridge and a downwardly angled portion circumferentially outward of the upper ridge. Underneath this downwardly angled portion are downwardly angled teeth which match the teeth of the pinion gear 73.

The angle gear 75 may have a generally conical inside portion and a series of reinforcement ribs, if necessary. Angle gear 75 rotates about a first axis 77, even though the off set exploded view of FIG. 2 may not appear to align the components common to first axis 77. The rotation of the angle gear 75 with an integrated smaller diameter central pinion gear (not seen in FIG. 2) which is located near the center of the angle gear 75 and is on axis 77, and engages outer teeth of a second gear 79 which rotates about an axis 81.

Second gear 79 rotates about an axis 81 which may be spaced apart from the axis 77. Likewise, the rotation of the second gear 79 about axis 81 causes an integrated smaller diameter central underlying pinion gear (not seen in FIG. 2) to engages an outer gear teeth set of a third gear 83 which may rotate about the axis 77. Likewise, the rotation of the third gear 83 about axis 77 causes an integrated smaller diameter central underlying pinion gear (not seen in FIG. 2) to engage an outer gear teeth set of a fourth gear 85 which may rotate about the axis 81. Further, the rotation of the fourth gear 85 about axis 81 causes an integrated smaller diameter central underlying pinion gear (not seen in FIG. 2) to engage outer gear teeth set of a fifth gear 87 which may rotate about the axis 77.

The fifth gear 87 is the final stage of the gear train and includes a lower sun gear portion (not seen in FIG. 1) of an epicyclic gear assembly which will be hereinafter described. Below the fifth gear is seen a separator fitting 89 which helps to distribute loads and reduce the wear of a set of three planetary gears 91. Planetary gears 91 are each rotationally supported by a planet gear carrier 93. The drive force from the planet gear carrier 93 is utilized to drive the first and second lid jaw racks 51 and 53.

The separator fitting 89, three planetary gears 91 and planetary gear carrier 93 are all upwardly supported and partially enveloped within an annular and main jaw drive 95. The drive force from the planet gear carrier 93 is utilized to drive the first and second lid jaw racks 51 and 53. The fifth gear 87 imparts its force to the planetary gears 91 and moves independently of any direct fixation with respect to the annular and main jaw drive 95. To the extent that the fifth gear 87 and annular and main jaw drive 95 may touch, their movement based on such touching may involve some, but preferably minimal friction. One function of the separator fitting 89 is to set the height of the annular and main jaw drive 95 with respect to the fifth gear 87, so as to control the forces and set separation heights along with the integral bearing surface of fifth gear 87 against drive shaft 127.

The important result of the system shown is that movement of the fifth gear 87 in one direction will cause the planet carrier 93 to move in the same direction, but should the planet carrier 93 experience a resistance to movement, the opposite motion will result in the annular and main jaw drive 95. Thus, the planetary gear system enables the splitting of force and motion output from the gear system which is useful in the opposite motion and forces developed in removing lid 35 from the jar 37.

Other components seen in FIG. 2 is an internal support insert 99 which has a number of shapes and surfaces. A pair of cylindrical shaped openings 101 are seen to support battery carriage and insertion. A battery door 103 may be provided to interfit with the main housing 23 and to enclose batteries within the cylindrical shaped openings 101. Electrical contacts 105 may be provided to control the series or parallel connection of the batteries which will fit into the cylindrical shaped openings 101, which may be "AA" type batteries, for example.

Internal support insert 99 can also be seen as supporting a number of other components, including switches 107 and stop/reverse switch 109. A low friction annulus support area 111 has a shape and surface made for rotationally supporting the annular and main jaw drive 95 with stable rotation and low friction. As can be seen, the internal support insert 99 fits within the inside open area of the lower housing 27. The lower housing 27 can be seen as having a pair of rack openings 113, only one of which can be seen in the perspective of FIG. 2. A main opening 115 is provided for transmission of rotational power to the first and second lid jaw racks 51 and 53. Other structures are seen in the lower housing 27 to facilitate registry, support and attachment of both the internal support insert 99 and upper housing 25.

Outboard, fore and aft of the lower housing 27 is a better and more complete view of the first and second main jaws 41 and 43. The rack portions 45 can be seen as having an open slot with a set of teeth 117 on one side. The teeth sets are oppositely oriented with respect to each other to engage the main jaw drive pinion gear 95, (not shown in FIG. 2) so that when the pinion is turned in one direction, the first and second main jaws 41 and 43 open and when turned in the other direction the first and second main jaws 41 and 43 close. As can be seen, the portions of the first and second main jaws 41 and 43 outboard of the main slot have cutaway portions 119 so that the rack portions 45 of the first and second main jaws 41 and 43 can move more closely together in a more mutually supported relationship, especially during closure/grasping.

Below the lower housing 27 the rotation housing 29 is seen has having a rotational fitting 121 which is vertically fixed within the lower housing 27 but freely rotatable. Below the rotational fitting 121 a pinion gear 125 is shown in an exploded relationship and which fits much more closely to the rotational fitting 121, and rotation housing 29 and can be seen from the bottom of the jar opener 21 as assembled. Rotational fitting 121 operates within a defined space and enables the pinion gear 125 to turn freely by a shaft 127. The pinion gear 125 engages teeth 129 on one side of each of the first lid jaw racks 51 and 53. The arrangement is such that the turning of the pinion gear 125 in one direction causes the first lid jaw racks 51 and 53 move their downwardly extending lid grip member 59 away from each other, and where movement of the pinion gear 125 in the other direction causes the first lid jaw racks 51 and 53 move their downwardly extending lid grip member 59 towards each other to form a grip on the lid 35.

As can be seen from FIG. 2, and as will be explained, the rotational fitting 121 is used both for a force threshold differentiator and for a rotational position indicator. In the exploded view, and seen above and seeming to cover the rotation housing 29 is a thin upper planar portion 131 which will be attached to the bottom of the lower housing 27 and which does not rotate with respect to the rotation housing 29. The thin upper planar portion 131 supports, or may simply cover, a force arm 141 which has a cam extension 143 which extends into a curving cam slot (not clearly seen in FIG. 2) which is carried by the rotational fitting 121. At the other side of the thin upper planar portion 131 a switch arm 145 also has a cam follower 147 which operates stop/reverse switch 109 based upon the position of the rotational fitting 121.

Alternatives to the output from the epicyclic system which also shares torque between two gripping mechanisms with the relative sequence of outputs controlled by these include slipping clutches, spring loaded grips and meshing gears. The epicyclic gear train is preferred because it has few loses, it is very efficient, it also gives a gearing ratio, as a useful by-product of the differential. This means that less torque is needed to power it, and so a lower gearing ratio from a motor/gearbox power source is needed, which is both more efficient and uses fewer parts.

Generally, slipping clutches waste a lot of energy, as they often slip for a long period in a mechanical cycle, representing lost energy. Spring loaded grips can only give a gripping force proportional to the spring rates, which may not match the gripping force required to avoid slipping. Meshing gears may work where one or both the gripping mechanisms are belt-like, but such devices are not as easy to mount on containers and lids.

The preferred embodiment of the jar opener 21 operates by placing it on the flat topped lid 35 of a screw top container or jar 37, and pressing the start button 31. This one-touch feature means that other activities can be carried out by the user while the opener is operating. The start button 31 presses switches 107, one of which is latching and resets the drive direction, and the other starts the geared electric motor 69 to drive the sun gear underneath the fifth gear 87 of the epicyclic gear train. The two sets of gripping jaws including first and second main jaws 41 and 43 first and second lid jaws 51 and 53 are connected to the epicyclic gear assembly, including separator fitting 89, three planetary gears 91, planet gear carrier 93, annular and main jaw drive 95 and shaft 127. The diameters of the drive gears of the epicyclic gear assembly are adjusted to balance the different output torques of the annular and main jaw drive 95 (higher torque), and the planet gear carrier 93 (lower torque), such that the gripping forces can be more evenly distributed.

Generally, motion of the fifth gear 87 might act to close both the first and second main jaws 41 and 43 and the first and second lid jaws 51 and 53 simultaneously, but the gear sizes and friction of the fittings can be adjusted to cause the closure of the first and second main jaws 41 and 43 to occur first, and then the first and second lid jaws 51 and 53 to close after the first and second main jaws 41 and 43 have engaged the jar 37.

An even more positive gripping force of the first and second main jaws 41 and 43 and the first and second lid jaws 51 and 53 is created by the action of the force arm 141 and cam extension 143 into the rotational fitting 121 (the force created also being shared back through the differential epicyclic gear assembly). Initial rotation of the pinion gear 125 proceeds until the first and second lid jaws 51 and 53 are closed around the lid 35, either just after or simultaneous to the closing of the first and second main jaws 41 and 43. Once all jaws are closed, additional force transmitted to the pinion 125 through the shaft 127 will result in a rotational force on the rotational fitting 121 sufficient to cause the rotational fitting 121 to overcome the resistance to its rotational motion imparted to it by the force of the force arm 131 urging the cam extension 133 into a curved cam slot. Once this occurs, the rotation housing 29 proceeds to rotate, along with the first and second lid jaws 51 and 53 which have already been urged into a high compression relationship against the lid 35. As the pinion gear 125 continues to rotate, the rotation of the rotation housing 29 with lid 35 grasped in place, occurs with respect to the lower housing 27 and first and second main jaws 41 and 43 which remain in place with respect to the grasped jar 37.

The result is the opening of the jar 37 once enough torque force is applied between the jar 37 and lid 35. Once the initial opening force resistance is overcome, the rotational housing 29 continues to turn one hundred eighty degrees with respect to the lower housing 27 and the planar upper portion 131. The control can be accomplished by sensors, stop switches, latching switches and the like, but it is preferred for a reversal of the motor 69 to occur in combination with the force components set up to sequentially reverse the actions, but a complete understanding of reversal can be best understood by further illustrations.

Figure 3:
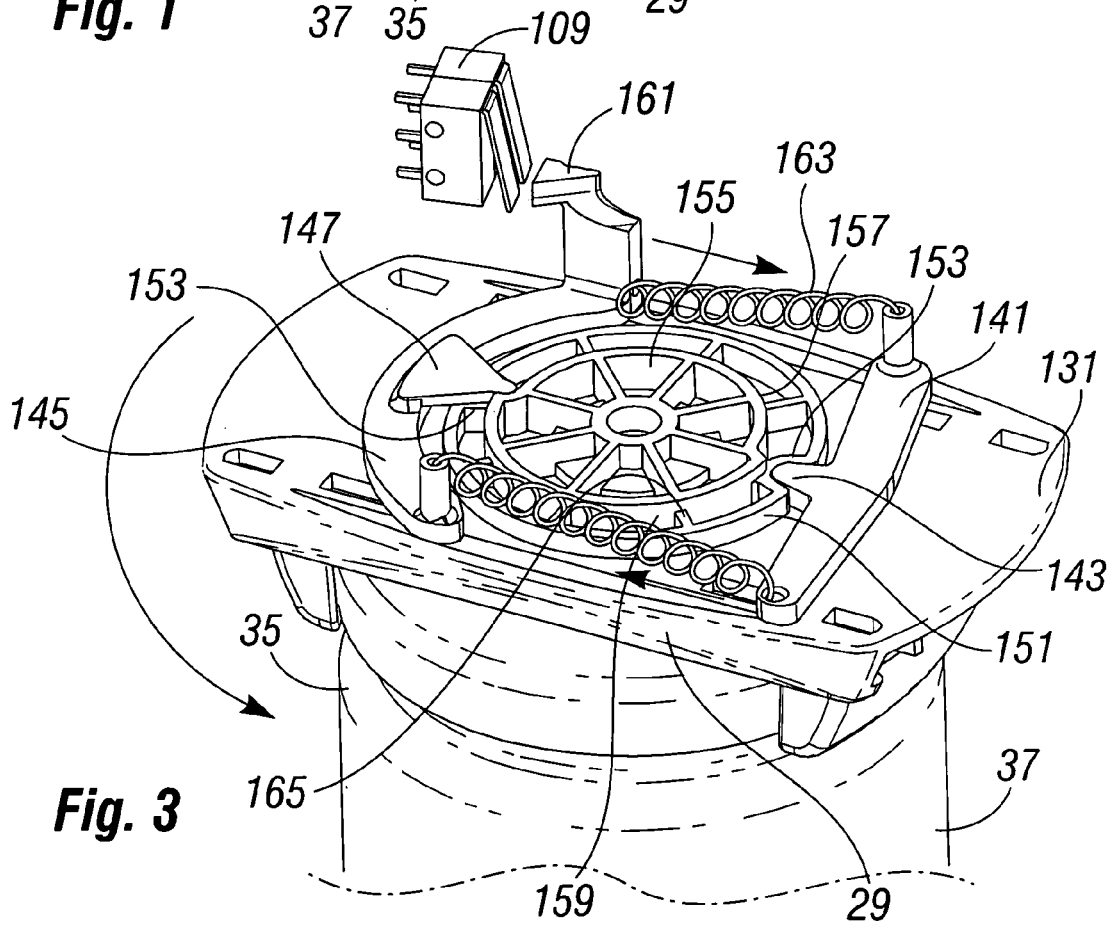
FIG. 3 is a perspective isolated view of the rotation housing and covering thin planar upper portion which supports a pair of cam operated structures surrounding a rotational fitting, and shown in a position ready to start a jar opening cycle.

Referring to FIG. 3, a closeup perspective is seen of the rotational fitting 121, and surrounding structures and with respect to a jar 37 and lid 35. First, the rotational fitting 121 is made up of two portions, an outside portion 151 includes a pair of oppositely located cam slots 153, the left cam slot being obscured by the presence of an overlying cam follower 147 which extends over and across it. The inside portion has two cam slots 153 so that it can turn one hundred eighty degrees and then reset for a further activation.

An inside portion 155 is continuous with and rotates along with the outside portion 151, and has a slightly higher profile than the outside portion 151. The inside portion has a radially inwardly displaced cylindrical surface 157 to enable switch 109 to achieve one position when such inwardly displaced cylindrical surface 157 is in contact with the switch arm 145. The inside portion has a radially outwardly displaced cylindrical surface 159 to enable switch 109 to achieve another position when such outwardly displaced cylindrical surface 159 is not in contact with the switch arm 145.

As will be seen, the combination of switch 109 operating as a reversing switch will allow the jar opener 21 to operate in a series of single, one hundred eighty degrees cycles in which the first and second lid jaws 51 and 53 need only rotate one hundred eighty degrees during its forward lid 35 loosening action with reversal and re-set not involving a reverse one hundred eighty degree movement. This single cycling enables the jar opener 21 to be more convenient, eliminate the force and energy needed to move the first and second lid jaws 51 and 53 in a reverse direction. This also means that the jar opener 21 will be automatically returned to a position ready to again operate at the end of each cycle.

Also seen in FIG. 3 is an upper structure 161 which is used to physically actuate the switch 109. A first spring 163 is used to connect between the upper structure 161 and a suitable non-moveable fixing point on lower housing 27 (not shown) or the pivot of the force arm 141. This does not impede the movement of the force arm 141, but enables quick action by the cam follower 147 from cam walls 157 to 159 and back by a relatively light spring to enable quick action by the switch arm 145. A second spring 165 is used to connect between the end of the force arm 141 and a suitable non-moveable fixing point on lower housing 27 (not shown), or a pivot of the switch arm 145. This does not impede the movement of the switch arm 145. The spring 165 enables a more deliberate, force overcoming action by the torque in the turning movement of the rotational fitting 121 causing the cam slots 153 to act against the cam extension 143. Other spring arrangements can be realized.

Figure 4:
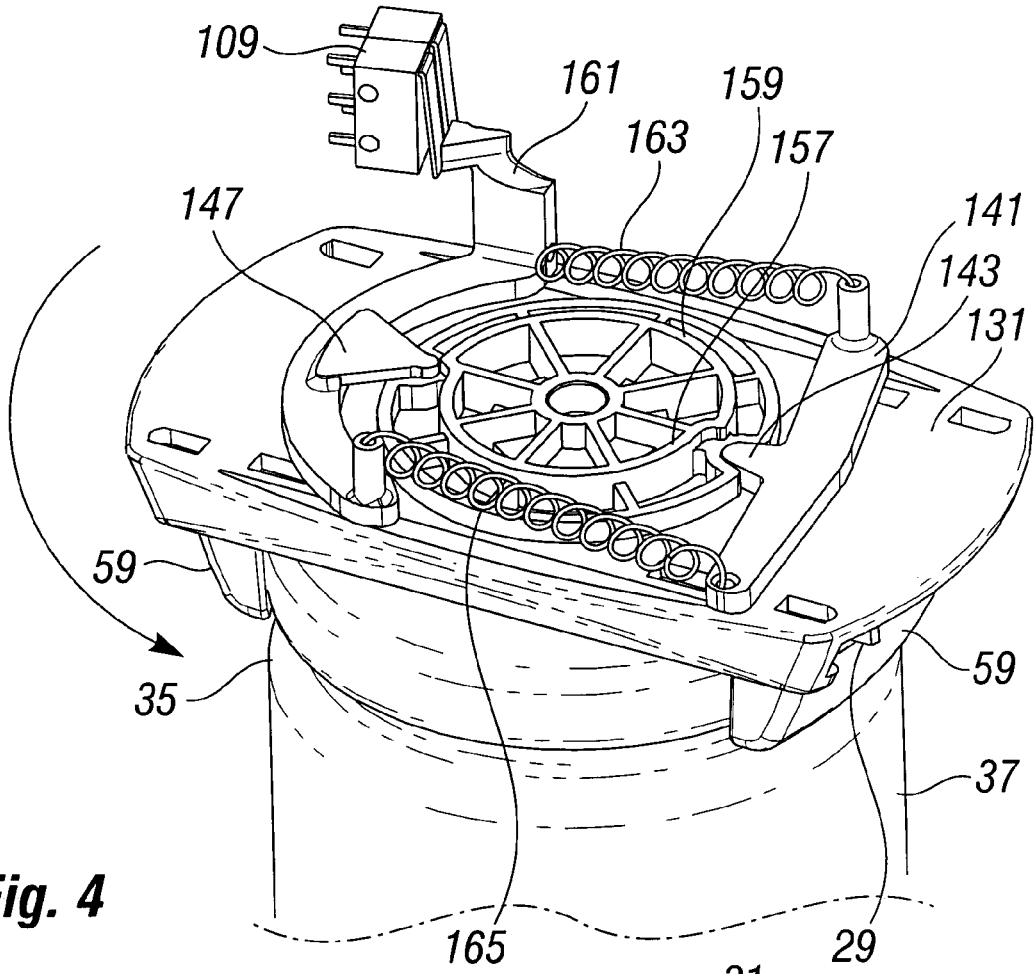
FIG. 4 is a perspective isolated view of the rotation housing and covering thin planar upper portion after it has gone through a one hundred eighty degree rotation and at the end of its jar opening cycle which corresponds to the beginning of a subsequent jar opening cycle.

Referring to FIG. 4, a view following the same perspective as was seen in FIG. 3 with respect to the planar upper portion 131, but with rotation housing 29 having been rotated relative to the planar upper portion 131, is shown. The aspects which appear changed is that the rotational fitting 121 has turned one hundred eighty degrees such that the radially inwardly displaced cylindrical surface 157 and radially outwardly displaced cylindrical surface 159 have changed places. This has caused the cam follower 147 to have only just been moved outward due to the presence of the radially outwardly displaced cylindrical surface 159. This has in turn caused the switch arm 145 to move such that the upper structure 161 has contacted and activated stop/reverse switch 109 to cause the main circuitry to reverse and instantly switch the drive motor 69 from moving forward to moving backward.

However, at this point where the motor 69 has reversed itself, it should be noted that the cam extension 143 has engaged the other cam slot 153 on the other side of the rotational fitting 121 and thus stabilized the rotational fitting 121 during the reversal. Cam extension 143 will not leave the other cam slot 153 into which it is resting until the positive rotation of housing 29 on the next jar opening sequence.

Further, and as can be seen by the rotation of the arrow (since rotation housing 29 only moves in one direction), the switch arm 145 will remain in a position urged outwardly by the cam follower 147 engagement with radially outwardly displaced cylindrical surface 159 for the next one hundred eighty degree rotation of the rotation housing 29. As will be seen, polarity reversal by the stop/reverse switch 109 will remain so reversed throughout the next one hundred eighty degree cycle and will only be reversed again at the end of such next one hundred eighty degree cycle when the mechanism assumes the position seen in FIG. 3.

Figure 5:
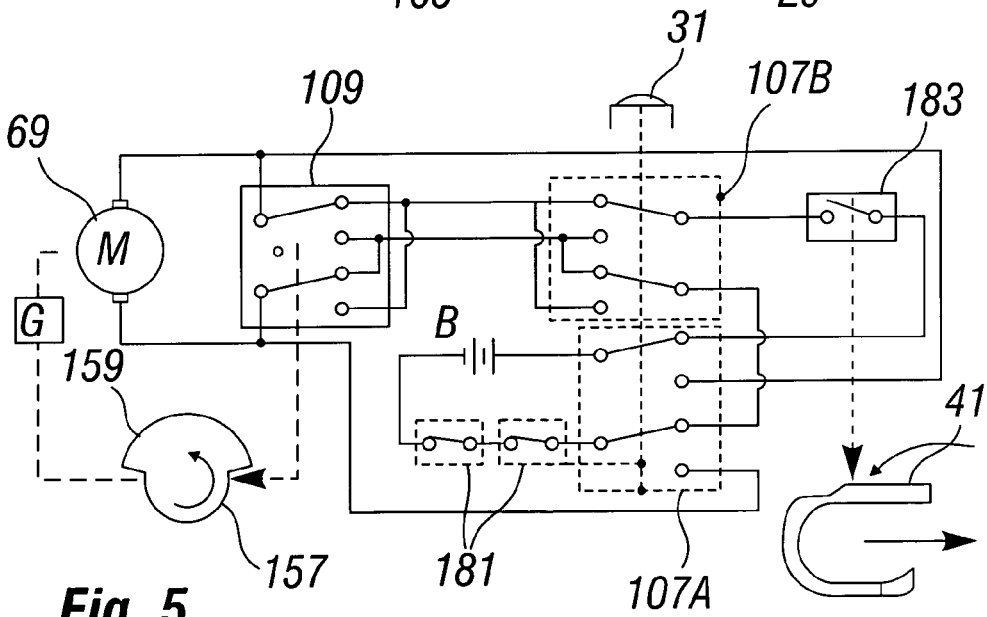
FIG. 5 illustrates an electromechanical realization of the power and switching circuitry for accomplishing a change of polarity which enables a single series of forward cycles and which could also be realized in a micro controller embodiment.

Referring to FIG. 5, one possible electrical schematic is illustrated, along with the mechanical actions associated with various switches. The circuit enables the forward moving nature of the mechanism which avoids reverse movement of the rotation housing 29 on reset. A battery "B" may preferably be two "AA" size batteries for a relatively small hand held jar opener 21. A pair of series disabling switches 181 may be used to isolate the battery. Disabling switches may be tilt switches to disable the jar opener 121 when it is not lying flat on a jar, or they might be trip switches which will not allow operation unless the jar opener 21 is sitting atop a flat lid. These disabling switches may be optical, mechanical or proximity type switches, to name a few.

Switches 107 are each actually two double throw double pole switches which are setup to provide polarity reversal and momentary contact override. In terms of pole reversal, the switches 107 somewhat "chase" the pole reversal which occurs with respect to switch 109. As described above, the cam action effect of the turning of the rotational fitting 121 reverses the motor polarity at the end of each opening cycle. This pole reversal is not automatically re-reversed at the end of the cycle. The user in essence re-reverses the polarity each time the user starts the jar opener 21.

Button 31 is mechanically attached to both of switches 107, including a momentary override switch 107A and a pole reversal switch 107B. Switch 107A is spring loaded and returns to the position seen in FIG. 5 after being depressed. Switch 107A is a latch switch which changes the switch state each time it is depressed. A stop switch 183 may be mechanically connected to one of the first and second main jaws 41 and 43, in this case shown to be main jaw 41. The outward extension of the first and second main jaws 41 and 43 at the end of their cycle is used to open stop switch 183 to stop the motor 69 after the reversal cycle is complete.

When the next cycle is started, depressing the button 31 does two things. First, it reverses the polarity of the motor from its last action in opening the jaws, and it does this via switch 107B. Secondly, the effect of switch 107A in its momentary contact, drives the motor 69 forward by overriding all of the other switches, regardless of polarity to start the motor 69 moving forward. Such forward movement will first begin to activate the first and second main jaws 41 and 43 to begin to close and thus immediately close switch 183. Switch 183 is open only when the first and second main jaws 41 and 43 (or one of them) is fully outwardly retracted. As a result, even a momentary forward powering of the motor 69 which moves the first or second main jaws 41 and 43 even a little, will cause switch 183 be to be closed.

As the user lifts his finger from the button 31, the power from Battery B flows through the switch 107A as seen in FIG. 5, then through switch 183 and switch 109 and into the motor to continue driving motor 69 in the same forward direction. As before, the motor drives through gear box "G" and causes the cammed radially inwardly displaced cylindrical surface 157 and radially outwardly displaced cylindrical surface 159 to change places which then change the polarity of switch 109. At the beginning of the next cycle, the pressing of the button 31 momentarily starts motor 69 as before, due to the override of switch 107A, and when the button 31 is released, the switch 107B will be in the opposite position (matching the changed position of switch 109 and again cause the motor to be driven forward.

Figure 6:
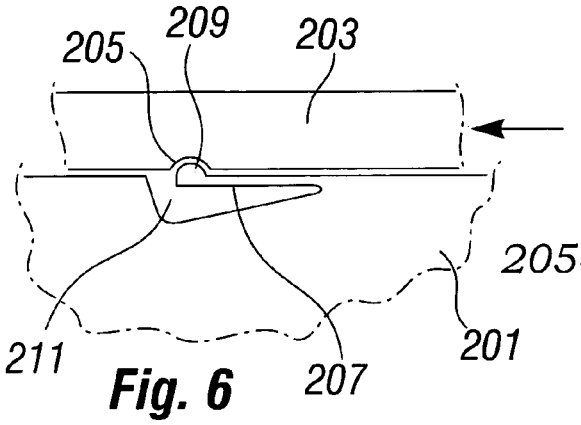
FIG. 6 is a side sectional view of two components which move past each other and use a lever mounted terminus which interfits with a notch.
Figure 7:
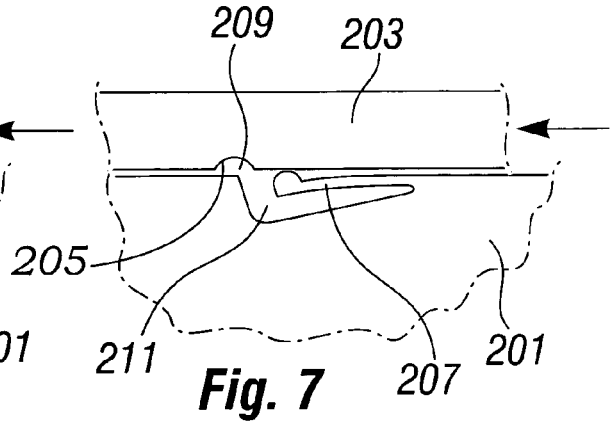
FIG. 7 illustrates the two components of FIG. 6 after movement has occurred and illustrating the compression of the cam operated structures into an accommodation space.

Referring to FIGS. 6 and 7 there is shown some other detent structures which can be used with any component of the jar opener which moves. Generally speaking, any member 201 which has any other member 203 sliding past it can use a detent system to provide a small force to be overcome before member 201 is allowed to move relative to a member 203, such as first and second main jaws 41 and 43 first and second lid jaws 51 and 53 and especially their rack portions. In FIG. 6, the member 203 has an indent 205 having a shape and depth formed in accord with the amount and type of action desired. Member 201 has an arm 207 having a terminus 209 for interacting with the indent 205. An accommodation space 211 is formed to enable the arm 207 to move freely out of the path of portions of member 203 not having the indent 205.

FIG. 7 illustrates that as member 203 moves with respect to member 201 that the arm 207 bends and the terminus 209 is pushed out of the way. In total, the force necessary to overcome the locking position seen in FIG. 6 will depend upon the materials chosen, shape of the terminus 209 and indent 205 and the thickness and shape of the arm 207.

Figure 8:
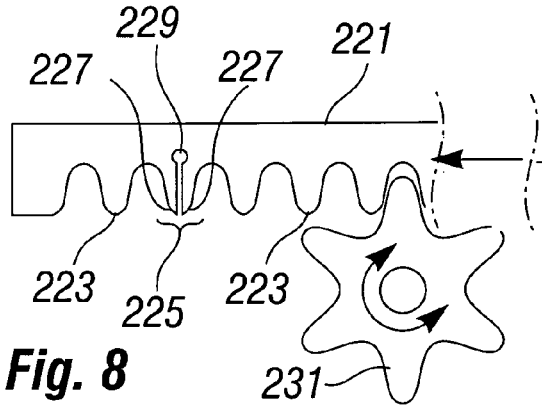
FIG. 8 illustrates an alternative for providing an energy "bump" or momentary energy differential by providing a pair of split teeth which are compressed to form an energy differential.

Other structures can be provided to cause a continuously movable rack to experience an energy or force gradient versus other structures connected in a competitive power train. Referring to FIG. 8, a Rack 221 has a series of even teeth 223. A split tooth 225 is actually made up of two half teeth 227 having outside edges which are spaced slightly wider apart, and about a slot 229 to provide clearance for compression, so that the regular teeth 223, so that when a pinion gear 231 attempts to roll past the split tooth 225, additional energy has to be spent to compress the two half teeth 227 toward each other. Where a competitive power train is present, energy and motion will be more readily used someplace else.

Figure 9:
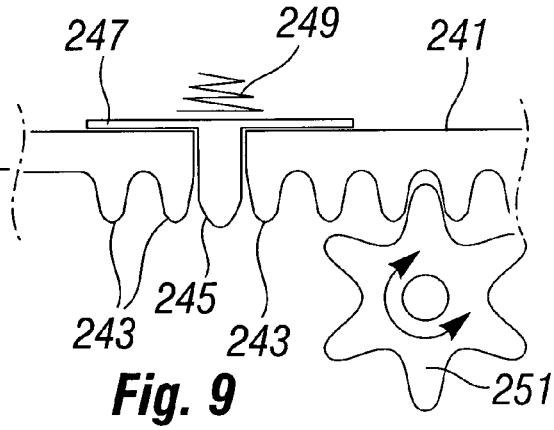
FIG. 9 illustrates an alternative for providing an energy "bump" or momentary energy differential by providing a slightly longer tooth 245 urged forward by a spring against a pinion gear to provide a point resistance.

Referring to FIG. 9, a Rack 241 has a series of even teeth 243. Space is provided in place of one of the teeth 223. In its place, a slightly longer tooth 245 is placed as a replacement tooth. The slightly longer tooth 245 has a base 247 against which a spring 249 urges the slightly longer tooth 245 outward so that when a pinion gear 251 attempts to roll past the protruding tooth 245, additional energy has to be spent to compress the spring 249. Again, where a competitive power train is present, energy and motion will be more readily used someplace else.

Figure 10:
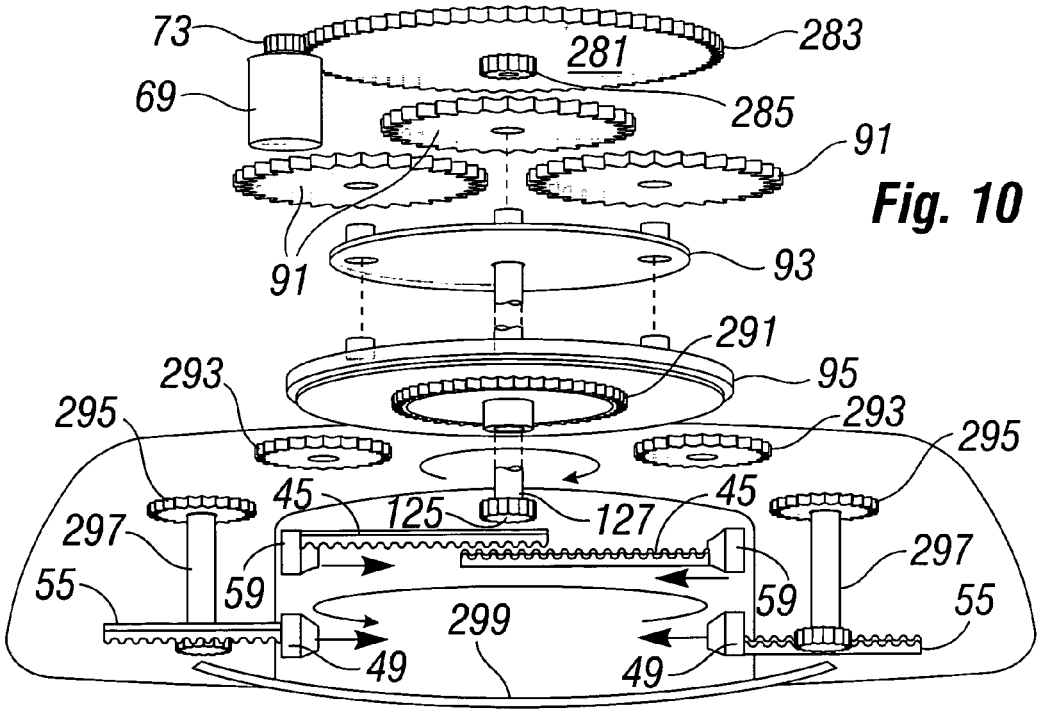
FIG. 10 illustrates another structure which can enable transmission of jar grasping forces to lower regions using vertical shafts and transfer gears, and also which illustrates a different orientation of structures within an epicyclic gear chain.

One of the aspects of the jar opener 21 is the fact that the operability of the jar grasping mechanism is above the lid grasping mechanism. The "reach around" of the jar grasping mechanism enables it to have the lower grasping extent. Other structure which enable the jar 37 grasping structures to move below the lid 35 grasping structures can be utilized. Referring to FIG. 10, the same numbering will be shown with respect to that seen in FIGS. 1-5 except where new structure is present.

A cover 281 has an integral gear 283 with which a motor 69 and pinion 73 may power. A pinion 285 is introduced to operate between the planet gears 91 such as was underneath the fifth gear 87, the difference here is that pinion 285 rotates with the cover 281, but in FIG. 2, the pinion underneath fifth gear 87 is rotated with respect to internals gears 95 located in an annulus below the fifth gear 87. As before, a planet carrier 93 has a shaft 127 terminating in a pinion gear 125. As before, underneath the lower annulus 95, an integral gear 291 is used to take power off through gears 293 and the gears 295 before power is passed through shafts 297 in order to activate rack portions 55. As before, pinion 125 actuates rack portions 45. A metal structure 299 by be used to circularly support the components, including the gears 293, 295, and shafts 297, and give a lower center of gravity, which improves the balance on smaller jar lids.

Referring to FIG. 11 a jar opener 301 wherein the gripping members using a belt topology is seen, as having an off center design and which can be used equally as well for a slender cylindrical bottle 303 as well as a large cylindrical jar 305. A button 307 controls a lower gripping member hereinafter referred to as belt 311 and an upper gripping member which is a tension link hereinafter referred to as belt 315, which will be more clearly seen as a toothed or ribbed belt 315, with the lower belt 311 engaging the bottle 303 or jar 305 and the upper belt 315 engaging a lid 317. Can opener 301 has a general "L" shaped housing 319 which either fits over a bottle or on the side of a jar 305.

Referring to FIG. 12, a side plan view illustrates the two belts 311 and 315 with some separation between them. It is not necessary that the lid 317 and jar 305 or bottle 303 be of exactly the same diameter. Referring to FIG. 13, a top view illustrates that the belt 315 has ribs 321 which are used to assist in grasping and pulling or pushing the belt in a driven manner.

Figure 14:
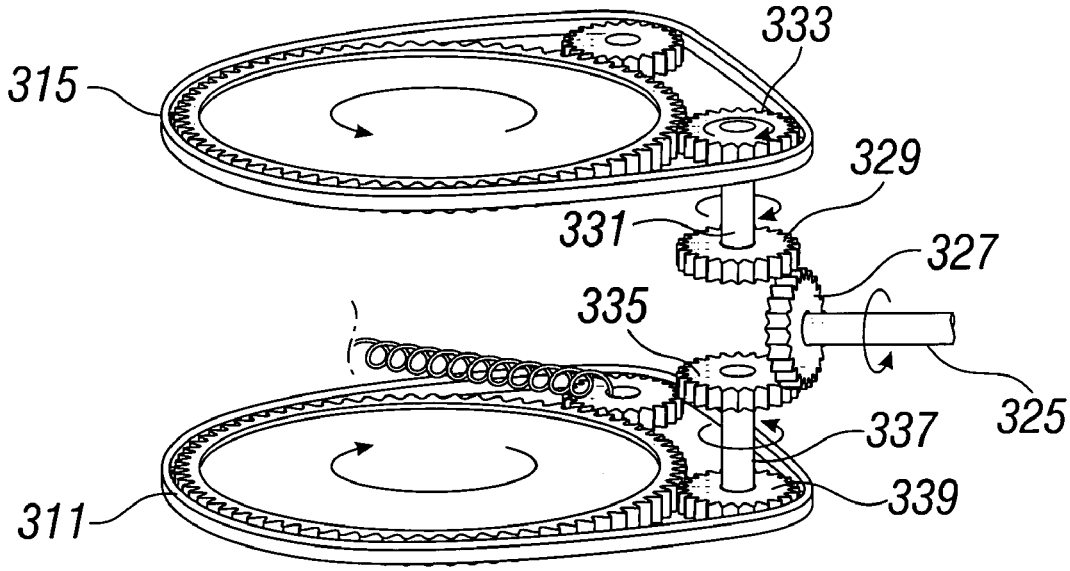
FIG. 14 is a gear schematic illustrating how a single power source input can urge upper and lower drive belts in opposite directions.

Referring to FIG. 14, one possible power input scheme is illustrates one possible power input method. A single shaft 325 terminates in a bevel gear 327. A counterclockwise turning of the bevel gear 327 results in a clockwise turning of an upper bevel gear 329 with a shaft 331 connected to an upper sprocket gear 333. Likewise, the counterclockwise turning of the bevel gear 327 results in a counterclockwise turning of a lower bevel gear 335 with a shaft 337 connected to an lower sprocket gear 339.

With a belt set, several options are available. The lower belt can simply tighten and the upper belt can be tightened and then moved in a counterclockwise direction. Further, tightening of the upper belt can occur prior to movement. Further, in the upper belt, one sprocket can tighten and then another sprocket can move against a take-up reel with a given (high) tension. For example, upper belt 315 can be taken up from the left until the belt is tight. A supply reel could be set to supply belt only beyond a threshold spring tension of fifty to one hundred pounds. Then the upper belt would tighten and continue to tighten until it exceeded, say a fifty pound tension at which time the upper belt acts to move the lid 317 in a counterclockwise direction until the upper lid is removed.

In general it is preferable for the first and second main jaws 41 and 43 first and second lid jaws 51 and 53 to have built in initial resistance so that they operate in a given, expected sequence each time. For example the devices shown in FIG. 6 through FIG. 9 can be used to control this sequence, and ensure that main jaws move first and reset last, to provide power for automatic movement by closing switch 183 throughout. This ensures that the button starts the sequence in one touch.

As has been shown, the epicyclic mechanism builds and shares the grip forces and utilizes excess torque forces as applied for to move the rotation housing 29 along with the lid 35. Adjusting the strength of the spring 165 can preset torque at which the opening operation begins. This is so that the friction between grips 49 and 59 and lid 35 and container body 37 will be large enough to avoid slippage. The seal between the jar 37 and lid 35 usually releases (with any destruction of vacuum) within the first quarter turn of unscrewing the lid 35.

In addition to the embodiment shown, a micro controller or chip can be used to provide the switching function, as well as other sensors for providing additional control.

Although the invention has been derived with reference to particular illustrative embodiments thereof, the utilization of the epicyclic force and torque balancing, control and single cycle forward principles can be applied to any number of appliances to achieve advantages embodied in the specification. It is clear many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. A jar opener comprising:

a manually portable housing;

a pair of opposing jar engaging gripping members extending from said housing;

a pair of opposing lid engaging gripping members extending from said housing below and adjacent said pair of opposing jar engaging gripping members' extension from said housing, said lid engaging gripping members freely rotatable with respect to said housing and said pair of opposing jar engaging gripping members, said pair of opposing jar engaging gripping members extending below said pair of opposing lid engaging gripping members;

a motor operably linked through a planet gear system to close said jar engaging gripping members onto a jar and to close said lid engaging gripping members onto a lid, and to move said lid engaging gripping members with respect to said jar engaging gripping members to open a jar;

a battery power supply;

a motor control capable of being actuated with a single manual actuation and controllably connected to said motor and to said battery power supply.

* * * * *